US005208411A

United States Patent [19]

Satoh

[11] Patent Number: 5,208,411

[45] Date of Patent: May 4, 1993

[54] SAXOPHONE WITH OCTAVE HOLE FOR PRODUCING AN OCTAVE HIGHER TONE

[75] Inventor: Fusao Satoh, Shizuoka, Japan

[73] Assignee: Yamaha Corporation, Hamamatsu, Japan

[21] Appl. No.: 686,407

[22] Filed: Apr. 17, 1991

[30] Foreign Application Priority Data

Apr. 18, 1990 [JP] Japan ..... 2-102335

[51] Int. Cl.[5] ..... G10D 7/08

[52] U.S. Cl. ..... 84/385 R

[58] Field of Search ..... 84/385 R, 386, 394

[56] References Cited

U.S. PATENT DOCUMENTS 1,735,411 11/1929 Powell ..... 84/385 R 3,783,732 1/1974 Ihara ..... 84/385 R

FOREIGN PATENT DOCUMENTS 51-46017 10/1976 Japan .

51-37770 11/1976 Japan .

*Primary Examiner*—Michael L. Gellner

*Assistant Examiner*—Cassandra C. Spyrou

*Attorney, Agent, or Firm*—Burns, Doane, Swecker & Mathis

[57] ABSTRACT

A saxophone comprises a tube member having one end portion gradually decreased in diameter toward a mouth piece, and a plurality of tone holes and an octave hole are formed in the tube member and the mouth piece, respectively, in association with a key mechanism and an octave key, wherein an enlarged portion is formed in one end portion of the tube member and larger in the inner diameter than adjacent portions thereof so that the depressed octave key allows the tube member to exactly produce a tone exactly twice as large in pitch as the previous tone.

6 Claims, 4 Drawing Sheets

SAXOPHONE WITH OCTAVE HOLE FOR PRODUCING AN OCTAVE HIGHER TONE

FIELD OF THE INVENTION

This invention relates to a saxophone and, more particularly, to the tube structure of a saxophone improved on production of a note in the high key.

DESCRIPTION OF THE RELATED ART

A typical example of the saxophone has a generally J-shaped tapered tube member coupled to a mouthpiece and is accompanied with a key mechanism selectively closing and opening tone holes assigned respective notes. An octave key is further provided in association with a hole formed in the tube member, and the octave key is used for increasing the pitch of a tone without manipulation of the key mechanism. When a player manipulates the octave key and the key mechanism remains unchanged, the saxophone produces a tone an octave higher than the previous tone.

FIG. 1 shows a typical fingering for the saxophone, and a dot and a bubble are indicative of a depressed key and a released key, respectively. A semi-dot and a semi-bubble are also indicative of a depressed key and a release key. The semi-dot and the semi-bubble closest to the mouth-piece stands for the octave key. The saxophone produces the tones of C, D, E, F, G, A and B in the first octave as well as the tone of C in the second octave while the octave key is released. However, the player needs to depress the octave key for producing the tones D, E, F, A and B of the second octave as well as the tone of C in the third octave. The octave key remains depressed for the tones of high-D, high-E, high-F and high-F#.

However, a problem is encountered in the prior art saxophone in that the tones of A, B and C in the second octave enclosed in dash lines tend to increase in pitch. This is because of the fact that the tube is tapered toward the mouthpiece. The depressed octave key tries to increase the pitch of the tone twice as large as the previous tone. However, the tapered tube promotes the increase of the pitch, and the tones of A, B and C tend to be slightly higher in pitch than the standard pitches exactly twice as high as the previous tones. Moreover, the depressed octave key decreases the column of air produced in the tapered tube for the tone of one of A, B and C, and this shorter column of air is unstable. Therefore, tones spaced apart by an octave acquire an undesirable imbalance with the upper tones increasing in tones.

Japanese Patent Publication (Kokoku) No. 51-37770 discloses an approach where an external air chamber is attached to the tapered tube. The external air chamber is located between the tone hole assigned to the high-F# and the mouth piece and projects from the outer surface of the tapered tube. The external air chamber may improve the tone-color. However, the external air chamber is less effective against the octave balance between the two tones spaced apart by an octave.

SUMMARY OF THE INVENTION

It is therefore an important object of the present invention to provide a saxophone which produces a plurality of tone pairs exactly doubled in pitch without sacrifice of the fingering thereof.

To accomplish the object, the present invention proposes to partially increase the diameter of a tapered tube member between the tone hole assigned to the highest tone and a mouthpiece.

In accordance with the present invention, there is provided a saxophone comprising a) a first tube member having one end portion gradually decreased in diameter toward one end thereof and the other end portion, a plurality of tone holes being formed in the first tube member, b) a second tube member coupled to the one end of the first tube member and having an octave hole formed wherein, a player blowing in through the second tube member so that a column of air produced in the first tube member and the second tube member vibrates, c) a key mechanism mounted on the first tube member and having a plurality of keys associated with the tone holes, one of the keys selectively closing and opening one of the tone holes closest to the second tube member, and d) an octave key selectively closing and opening the octave hole and used for producing a tone spaced apart from another tone by an octave, wherein the aforesaid one end portion of the first tube member has an enlarged portion larger in an inner diameter than adjacent portions of the aforesaid one end portion contiguous to the enlarged portion.

BRIEF DESCRIPTION OF THE DRAWINGS

The features and advantages of a saxophone according to the present invention will be more clearly understood from the following description taken in conjunction with the accompanying drawings in which.

DESCRIPTION OF THE PREFERRED EMBODIMENTS

First Embodiment

Figure 1:
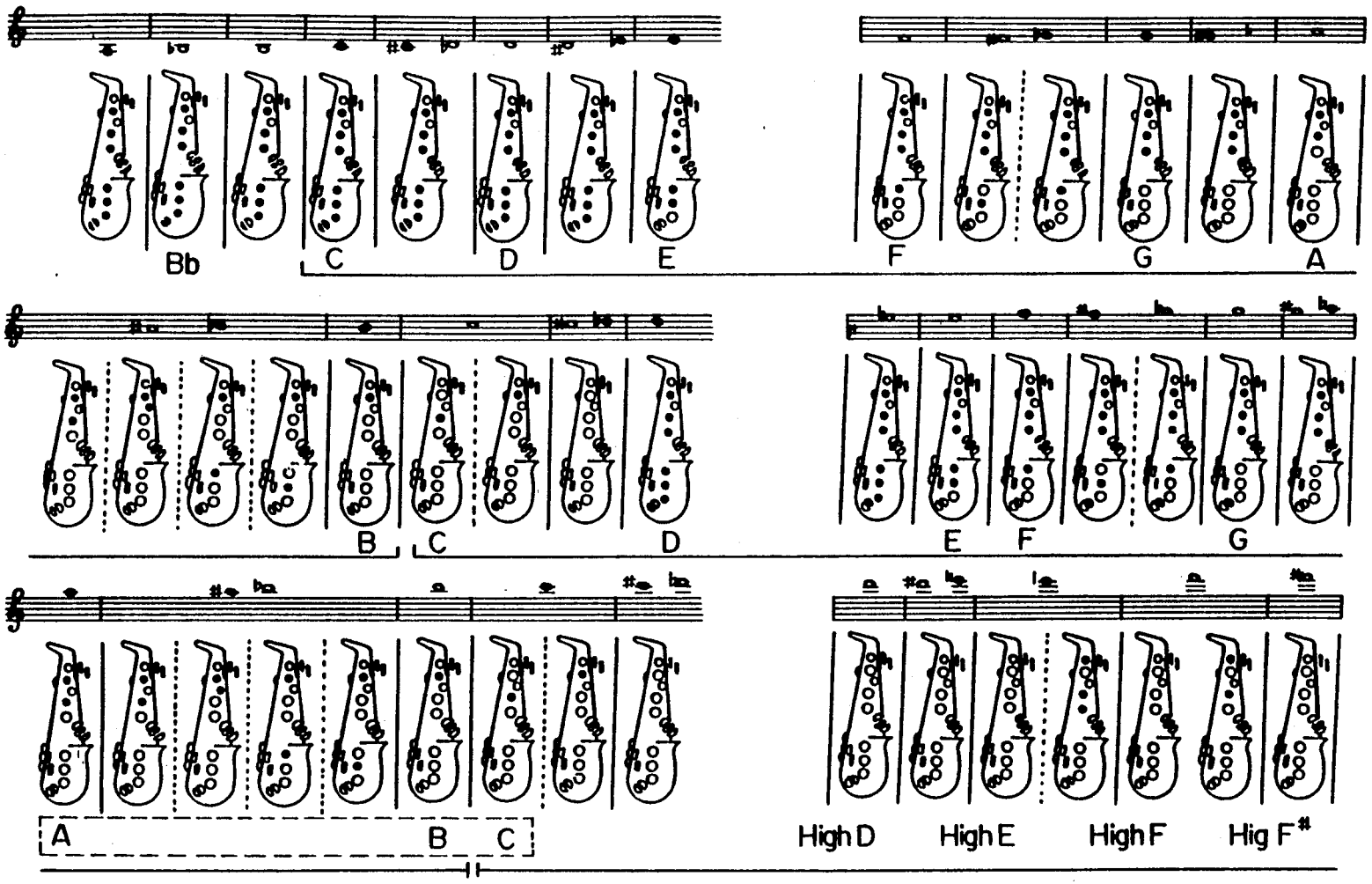
FIG. 1 PRIOR ART
FIG. 1 is a view showing the relationship between the fingering and the tones produced by a prior art saxophone.
Figure 2:
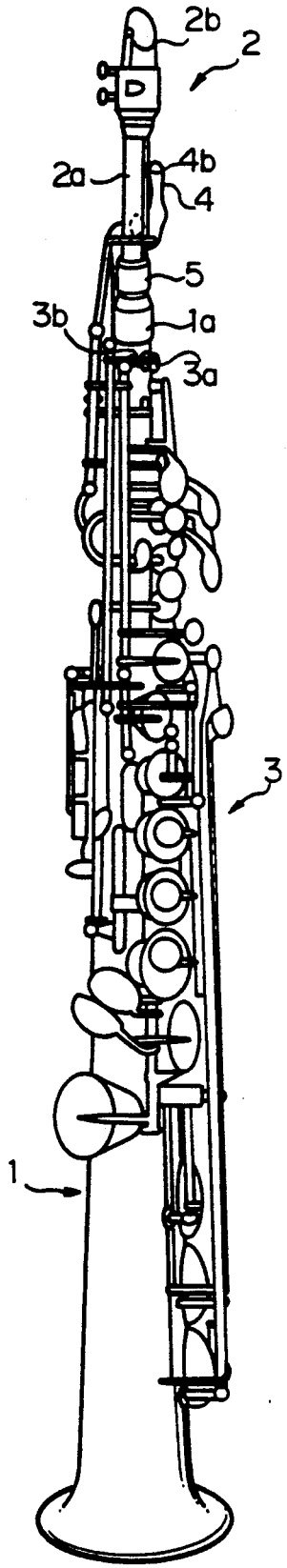
FIG. 2 is a perspective view showing a saxophone according to the present invention.

Referring to FIG. 2 of the drawings, a soprano saxophone in Bb comprises a tapered straight tube member 1, a straight blowing tube **2*a* coupled to the tapered straight tube member 1 and a mouthpiece 2*b* coupled to the straight blowing tube 2*a* and holding a reed. In this instance, the tapered straight tube member 1 serves as a first tube member, and the straight blowing tube 2*a* the mouth piece 2*b* form in combination a second tube member 2, respectively. Though not shown in the drawings, a plurality of tone holes are formed in the tapered straight tube member 1 and arranged along the longitudinal direction of the tapered straight member 1 at spacings. A key mechanism 3 selectively closes and opens the tone holes for varying the pitch of tone, and the key mechanism 3 includes a plurality of keys. One of the keys 3*a* of the key mechanism 3 is provided in association with one of the tone holes 3*b* assigned to the highest tone F#, and the tone hole 3*b* is closer to the straight blowing tube 2a than the other keys of the key mechanism 3. On the straight blowing tube 2a is provided an octave key selectively closing and opening an octave hole 4b** which aims at increase of pitch as twice as large as that of a previously produced tone.

Figure 3:
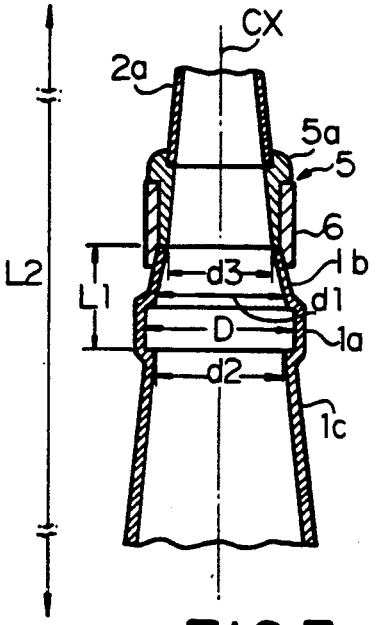
FIG. 3 is a cross sectional view showing the junction between a mouthpiece and a tapered tube member incorporated in the saxophone shown in FIG. 2.

The tapered straight tube member 2 is characterized by an enlarged portion 1a the inner diameter D of which is larger than those d1 and d2 of adjacent portions 1b and 1c contiguous thereto as will be better seen from FIG. 3. The enlarged portion 1a is located between the tone hole 3b and the octave hole 4b. In detail, one end portion of the straight tube member 1 is formed with the adjacent portion 1c, the enlarged portion 1a, the adjacent portion 1b and a coupling short tube 5 contiguous to one another. The adjacent portion 1c is gradually tapered toward the enlarged portion 1a, and the inner diameter is steeply increased from d2 to D. The enlarged portion 1a is substantially constant in the inner diameter D along the center axis thereof, and the inner diameter is rapidly decreased at the interface between the enlarged portion 1a and the adjacent portion 1b. The adjacent portion 1b is tapered toward the coupling short tube 5, and is aligned with the coupling short tube 5 in such a manner that the inner surfaces thereof are smoothly merged. The inner diameter at the interface between the adjacent portion and the coupling short tube 5 is adjusted to a predetermined inner diameter d3. The coupling short tube 5 is substantially constant in the outer diameter and has a step portion 5a. The straight blowing tube 2a is tightly inserted into the coupling short tube 5, and the coupling straight blowing tube 2a by the aid of a fastening member 6. If the fastening member 6 is loosed, the straight tube member 1 is separated from the straight blowing tube 2a.

The total length L1 of the enlarged portion 1a and the adjacent portion 1b is regulated to be a predetermined ratio R1 (L1/L2) with respect to the total length L2 of the straight tapered member 1 and the second tube member 2. Even if the straight tapered tube member 1 and/or the straight blowing tube 2a is prolonged, the total length L1 is also increased so that the predetermined ratio R1 remains unchanged. The ratio D to d3 is also regulated to a predetermined value, and the predetermined value is not changed regardless of the size of the saxophone. For example, if L2 is 650 milimeters, L1 is 23 milimeters. If D is 17.6 milimeters, d3 is 15.3 milimeters. In this instance, the ratio R1 is about 0.035, and the ratio D/d3 is about 1.15.

Figure 4:
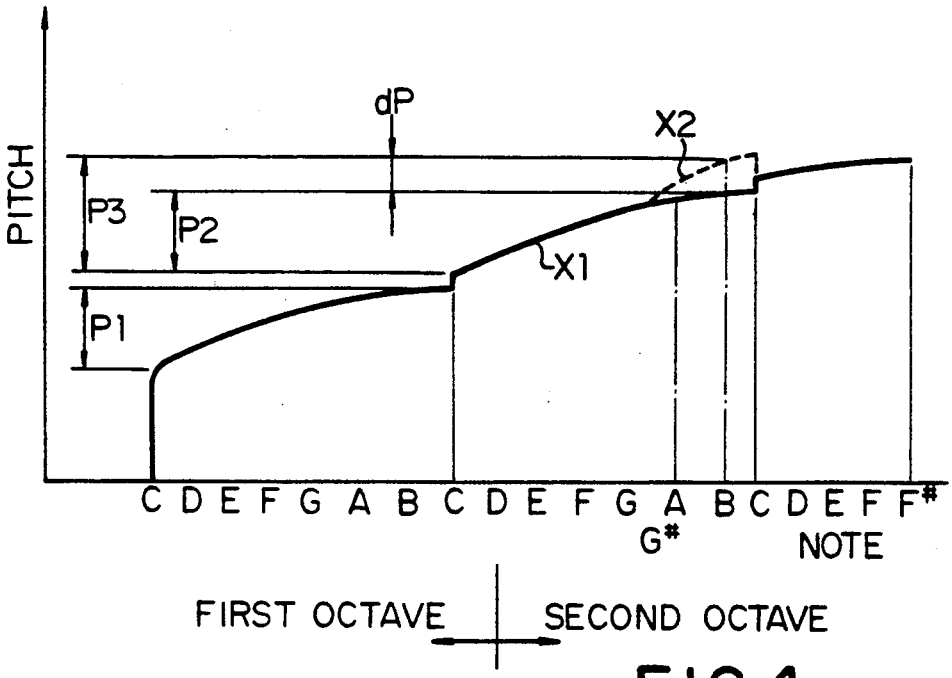
FIG. 4 is a graph showing the pitches in terms of the notes produced by the saxophone shown in FIG. 2 and the prior art saxophone.

When a player blows in through the mouth piece 2b, the reed causes a column of air produced in the second tube member 2 and the straight tube member 1 to vibrate, and the tone thus produced is changed depending upon the fingering. Plots X1 of FIG. 4 show variation of the pitch of the tone produced by the saxophone shown in FIG. 3, and plots X2 stand for variation of pitch of the tone produced by the prior art saxophone.

Although the tone produced by the prior art saxophone is excessively increased in pitch (compare P1 with P3), the saxophone according to the present invention exactly doubles the pitch between two notes spaced apart by an octave (compare P1 with P2). The difference dP between the pitches P2 and P3 is deleted from the saxophone according to the present invention, because the enlarged portion 1a makes the vibration of the column of air stable. In other words, the enlarged portion 1a is effective against undesirable increment dP, and the saxophone according to the present invention can produce a series of tones which are exactly doubled in pitch.

Second Embodiment

Figure 5:
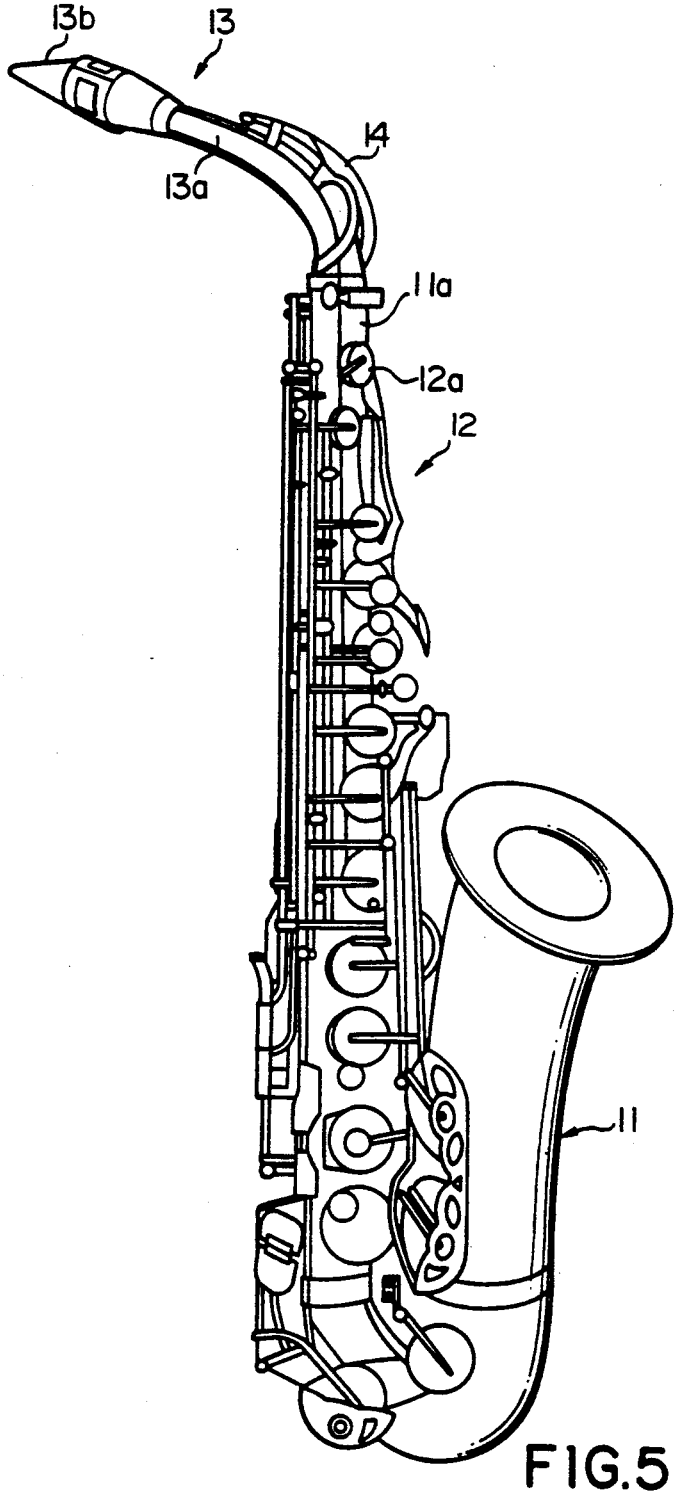
FIG. 5 is a perspective view showing another saxophone according to the present invention.

Turning to FIG. 5, an alto saxophone in Eb embodying the present invention comprises a generally J-shaped tube member 11 with a key mechanism 12, a curved blowing tube 13a with an octave key 14, and a mouth piece 13b. The J-shaped tube member 11 serves as a first tube member, and the curved blowing tube 13a and the mouth piece 13b as a whole constitute a second tube member 13. Though not shown in FIG. 5, tone holes are formed in the J-shaped tube member 11, and an octave hole is formed in the curved blowing tube 13a. The tone holes are selectively closed or opened with the keys of the key mechanism 12, and the octave key 14 is provided in association with the octave hole.

Figure 6:
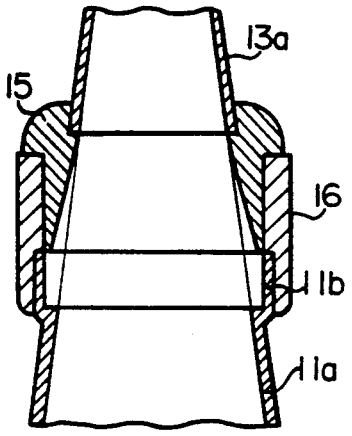
FIG. 6 is a cross sectional view showing the enlarged portion of a J-shaped tube member incorporated in the saxophone shown in FIG. 5.

One of the keys 12a of the key mechanism 12 is associated with one of the tone holes assigned to the highest note high-F# and is the closest to the octave hole. Between the tone hole assigned to high-F# and the octave hole the J-shaped tube member 11 is coupled to the curved blowing tube 13a as shown in FIG. 6. One end portion of the J-shaped tube member 11 has an adjacent portion 11a with a wind path decreased in the inner diameter toward the curved blowing tube 13a, an enlarged portion 11b contiguous to the adjacent portion 11a, and a coupling tube 15 interconnecting the enlarged portion 11b and the curved blowing tube 13a by the aid of fastening member 16. The coupling tube 15 has a wind path decreased in the inner diameter toward the curved blowing tube 13a, and the enlarged portion 11b has a straight wind path larger in the inner diameter than those of the adjacent portion 11a and the coupling tube 15. The coupling tube 15 serves as another adjacent portion.

The saxophone thus constructed produces a series of tones, and a tone is exactly doubled in pitch than the tone spaced apart by an octave by virtue of the enlarged portion. Since the enlarged portion 11b is perfectly covered with the fastening member 16, the appearance of the saxophone shown in FIG. 5 is similar to a conventional alto saxophone which is familiar with saxophone players.

Although particular embodiments of the present invention have been shown and described, it will be obvious to those skilled in the art that various changes and modifications may be made without departing from the spirit and scope of the present invention.

For example, any saxophone except for the soprano saxophone and the alto saxophone may be formed with an enlarged portion. Moreover, the soprano saxophone may be formed in the structure shown in FIG. 6, and another alto saxophone may have the structure shown in FIG. 3.

What is claimed is:

1. A saxophone comprising a) a first tube member having a first end portion gradually increasing in diameter toward a second end thereof and a plurality of tone holes being formed in said first tube member, b) a second tube member coupled to said first end of said first tube member and having an octave hole formed therein so that a player blowing in through said second tube member forms a column of air vibrating in said first tube member and said second tube member, c) a key mechanism mounted on said first tube member and having a plurality of keys associated with said tone holes, one of said keys selectively closing and opening one of said tone holes closes to said second tube member, and d) an octave key selectively closing and opening said octave hole and used for producing a tone spaced apart from another tone by an octave, wherein said first end portion of said first tube member has an enlarged portion, said enlarged portion being formed about an entire inner circumference of said first tube member to establish an inner diameter larger than adjacent portions of said first end portion contiguous to said enlarged portion.

2. A saxophone as set forth in claim 1, in which an inner diameter of said enlarged portion is substantially constant.

3. A saxophone as set forth in claim 5, in which the total length of said enlarged portion and said second adjacent portion is regulated to be a predetermined ratio with respect to a total length of said first tube member and said second tube member.

4. A saxophone as set forth in claim 3, in which said enlarged portion and an interface between said second adjacent portion and said coupling tube respectively have first and second inner diameters, and in which said first and second inner diameters are regulated to a predetermined ratio.

5. A saxophone comprising a) a first tube member having a first end portion gradually increasing in diameter toward a second end thereof and a plurality of tone holes being formed in said first tube member, b) a second tube member coupled to said first end of said first tube member and having an octave hole formed therein so that a player blowing in through said second tube member forms a column of air vibrating in said first tube member and said second tube member, c) a key mechanism mounted on said first tube member and having a plurality of keys associated with said tone holes, one of said keys selectively closing and opening one of said tone holes closest to said second tube member, and d) an octave key selectively closing and opening said octave hole and used for producing a tone spaced apart from another tone by an octave, wherein said first end portion of said first tube member has an enlarged portion with a larger inner diameter than adjacent portions of said first end portion contiguous to said enlarged portion, said first end portion further comprising:

a first adjacent portion with a wind path tapered toward said enlarged portion, said enlarged portion being substantially constant in inner diameter, a second adjacent portion with a wind path tapered away from said enlarged portion, a coupling tube coupled to said second adjacent portion and having a wind path smoothly merged with the wind path of said second adjacent portion, and a fastening member for interconnecting said coupling tube with said second tube member.

6. A saxophone comprising a) a first tube member having a first end portion gradually increasing in diameter toward a second end thereof and a plurality of tone holes being formed in said first tube member, b) a second tube member coupled to said first end of said first tube member and having an octave hole formed therein so that a player blowing in through said second tube member forms a column of air vibrating in said first tube member and said second tube member, c) a key mechanism mounted on said first tube member and having a plurality of keys associated with said tone holes, one of said keys selectively closing and opening one of said tone holes closest to said second tube member, and d) an octave key selectively closing and opening said octave hole and used for producing a tone spaced apart from another tone by an octave, wherein said first end portion of said first tube member has an enlarged portion with a larger inner diameter than adjacent portions of said first end portion contiguous to said enlarged portion, said first end portion further comprising:

a first adjacent portion with a wind path tapered toward said enlarged portion, said enlarged portion being substantially constant in inner diameter, a coupling tube serving as a second adjacent portion and having a wind path tapered away from said enlarged portion, and a fastening member covering said enlarged portion for interconnecting said coupling tube between said enlarged portion and said second tube member.

* * * * *